US008844501B2

(12) United States Patent
Dölker

(10) Patent No.: US 8,844,501 B2
(45) Date of Patent: Sep. 30, 2014

(54) CONTROL AND REGULATION METHOD FOR AN INTERNAL COMBUSTION ENGINE HAVING A COMMON RAIL SYSTEM

(75) Inventor: Armin Dölker, Friedrichshafen (DE)

(73) Assignee: MTU Friedrichshafen GmbH, Friedrichshafen (DE)

( * ) Notice: Subject to any disclaimer, the term of this patent is extended or adjusted under 35 U.S.C. 154(b) by 798 days.

(21) Appl. No.: 13/130,806

(22) PCT Filed: Nov. 9, 2009

(86) PCT No.: PCT/EP2009/007989

§ 371 (c)(1),
(2), (4) Date: May 24, 2011

(87) PCT Pub. No.: WO2010/057588

PCT Pub. Date: May 27, 2010

(65) Prior Publication Data

US 2011/0220066 A1 Sep. 15, 2011

(30) Foreign Application Priority Data

Nov. 24, 2008 (DE) ..... 10 2008 058 720

(51) Int. Cl.

| | |
|---|---|
| ***F02M 59/36*** | (2006.01) |
| ***F02M 69/54*** | (2006.01) |
| ***F02D 41/38*** | (2006.01) |
| *F02D 41/20* | (2006.01) |
| *F02D 41/14* | (2006.01) |

(52) U.S. Cl.

CPC .... *F02D 41/3845* (2013.01); *F02D 2200/0602* (2013.01); *F02D 2041/2027* (2013.01); *F02D 2041/1432* (2013.01); *F02M 59/366* (2013.01)

USPC ..... 123/458; 123/457

(58) Field of Classification Search

USPC ..... 123/446, 447, 456, 457, 458, 459, 495, 123/496, 497, 498, 499, 506, 510, 511

See application file for complete search history.

(56) References Cited

U.S. PATENT DOCUMENTS

| | | | | |
|---|---|---|---|---|
| 6,367,452 | B1 * | 4/2002 | Shima et al. | 123/457 |
| 6,792,916 | B2 * | 9/2004 | Oashi | 123/446 |

(Continued)

FOREIGN PATENT DOCUMENTS

| | | | |
|---|---|---|---|
| DE | 10030364 | A1 | 1/1987 |
| DE | 4020654 | | 1/1992 |
| DE | 10330466 | B3 | 10/2004 |
| DE | 102005020362 | | 11/2006 |

(Continued)

*Primary Examiner* — Mahmoud Gimie
*Assistant Examiner* — Sizo Vilakazi
(74) *Attorney, Agent, or Firm* — Lucas & Mercanti, LLP; Klaus P. Stoffel

(57) ABSTRACT

The invention relates to a control and regulation method for an internal combustion engine having a common rail system, wherein a rail pressure is regulated in normal operation in that a first actual rail pressure is determined via a first filter from the rail pressure, an offset is calculated from a target rail pressure and the first actual rail pressure, a variable is calculated via a pressure regulator from the offset and a PWM signal having a first PWM frequency (f1) for activation of a control process is determined in dependence on the variable. A second actual rail pressure (pCR2(IST) is determined via a second filter, a load rejection is recognized if the second actual rail pressure (pCR2(IST)) exceeds a first threshold value (GW1), upon exceeding the first threshold value (GW1) the PWM signal switches over from the first PWM frequency (f1) to a second PWM frequency (f2) and the rail pressure is controlled upon exceeding a second threshold value in that the PWM signal is temporarily set to a PWM value that is higher than that of normal operation.

3 Claims, 4 Drawing Sheets

(56) References Cited

U.S. PATENT DOCUMENTS

| | | | | |
|---|---|---|---|---|
| 7,779,816 | B2 * | 8/2010 | Dolker | 123/456 |
| 2008/0059039 | A1 * | 3/2008 | Nakagawa et al. | 701/99 |
| 2009/0223488 | A1 * | 9/2009 | Dolker | 123/456 |
| 2011/0220066 | A1 | 9/2011 | Dölker | |

FOREIGN PATENT DOCUMENTS

| | | | |
|---|---|---|---|
| DE | 102005029138 | B3 | 12/2006 |
| DE | 102008058720 | | 5/2010 |
| EP | 1298307 | A2 | 4/2003 |
| JP | 58174773 | | 10/1983 |

* cited by examiner

CONTROL AND REGULATION METHOD FOR AN INTERNAL COMBUSTION ENGINE HAVING A COMMON RAIL SYSTEM

The present application is a 371 of International application PCT/EP2009/007989 filed Nov. 9, 2009, which claims priority of DE 10 2008 058 720.6, filed Nov. 24, 2008, the priority of these applications is hereby claimed and these applications are incorporated herein by reference.

BACKGROUND OF THE INVENTION

The invention concerns a method for the open-loop and closed-loop control of an internal combustion engine with a common rail system, in which, during normal operation, the rail pressure is controlled by closed-loop control, and, when a load reduction is detected, a change is made from closed-loop control to open-loop control, wherein, during the open-loop control operation, the PWM signal is temporarily set to a PWM value that is higher than in normal operation in order to act on the controlled system.

In a common rail system, a high-pressure pump delivers the fuel from a fuel tank to a rail. The admission cross section to the high-pressure pump is determined by a variable suction throttle. Injectors are connected to the rail. They inject the fuel into the combustion chambers of the internal combustion engine. Since the quality of the combustion is decisively determined by the pressure level in the rail, this pressure is automatically controlled. The closed-loop high-pressure control system comprises a pressure controller, the suction throttle with the high-pressure pump, the rail as the controlled system, and a filter in the feedback path. In this closed-loop high-pressure control system, the controlled variable is the pressure level in the rail. The measured pressure values in the rail are converted by the filter to an actual rail pressure and compared with set rail pressure. The control deviation obtained by this comparison is then converted to a control signal for the suction throttle by the pressure controller. The control signal corresponds, e.g., to a volume flow in the unit of liters/minute. The control signal is typically electrically generated as a PWM (pulse-width-modulated) signal of constant frequency, for example, 50 Hz. The closed-loop high-pressure control system described above is disclosed by DE 103 30 466 B3.

Due to the high dynamic response, a load reduction is an event that is difficult to control from the standpoint of automatic control engineering. For example, after a load reduction, the rail pressure can rise with a pressure gradient of up to 4000 bars/second. If, for example, the internal combustion engine is being operated at a steady rail pressure of 1800 bars, and if the PWM frequency is 50 Hz, corresponding to a period duration of 20 ms, the rail pressure can rise by up to 80 bars before there is a response to the load reduction by the change in the PWM signal. Further complicating the situation is the fact that determination of the pressure signal, computation of the correcting variable, and output of the PWM signal occur at different times. In the most unfavorable case, the resulting lag time can be up to two PWM periods. This lag time is critical, because the maximum rail pressure is limited by a passive pressure control valve, which opens, for example, at 1950 bars.

To improve the reliability of the closed-loop pressure control in a load reduction, DE 10 2005 029 138 B3 proposes that the control operation be changed from closed-loop control to open-loop control. In the open-loop control operation, the PWM signal for activating the suction throttle is temporarily set to an increased PWM value by a step function, which accelerates the closing process of the suction throttle.

To improve the dynamic response for large jumps in set value, DE 40 20 654 A1 proposes that the end of the pulse of the PWM signal or the frequency of the PWM signal track the actual development of the set values and actual values. However, the basic prerequisite for this method is the synchronous start of the PWM signal and the determination of the set/actual values. This method is out of the question for closed-loop pressure control in the common rail system, because asynchronicity of closed-loop pressure control and PWM signal is normally the case. In addition, during a load reduction, frequency tracking in the sense of a frequency increase with a subsequent frequency reduction is not technically feasible due to the high pressure gradient.

To reduce the pressure oscillations in the rail, which are set in motion by the suction valve, DE 103 30 466 B3 proposes a frequency change of the PWM signal. To this end, the angular separation of two injections and the frequency of the PWM signal are used to compute a critical engine speed, at which the frequencies of the PWM signal and the injection are almost equally large, and from this a speed range is defined. If the engine speed passes through this speed range, the PWM signal is changed from a first frequency, for example, 100 Hz, to a second frequency, for example, 120 Hz. As a result of the frequency change, the high-pressure closed-loop control system is stabilized in the range around the critical speeds.

Proceeding from the temporary PWM assignment during a load reduction, as described in DE 10 2005 029 138 B3, the objective of the present invention is to further optimize the closed-loop pressure control during a load reduction.

As described in DE 10 2005 029 138 B3, a first filter is used to compute the first actual rail pressure, from which the control deviation is computed. At the same time, a second actual rail pressure is computed by a second, faster filter. A load reduction is then detected by virtue of the fact that the second actual rail pressure exceeds a first limit. When the load reduction is detected, the PWM signal is then switched from a first frequency, for example, 50 Hz, to a second, mush higher frequency, for example, 500 Hz. If the second actual rail pressure subsequently exceeds a second limit, the operation is changed to open-loop control with the temporary PWM assignment. The optimization thus consists in the fact that the lag time between the detection of the load reduction and the output of the PWM signal is shortened. This has the advantage of a significant reduction of the rail pressure overshoot after the load reduction.

The function is ended then the second actual rail pressure falls back below the first limit reduced by a hysteresis value. When the function ends, the PWM signal is then switched from the second frequency back to the first, lower frequency. Since the higher PWM frequency is set only during a short interval of time, the dissipation and the heat generation of the switching transistors in the electronic engine control unit remains within the specifications given by the semiconductor manufacturer.

SUMMARY OF THE INVENTION

A preferred embodiment of the invention is illustrated in the figures.

DETAILED DESCRIPTION OF THE INVENTION

Figure 1:
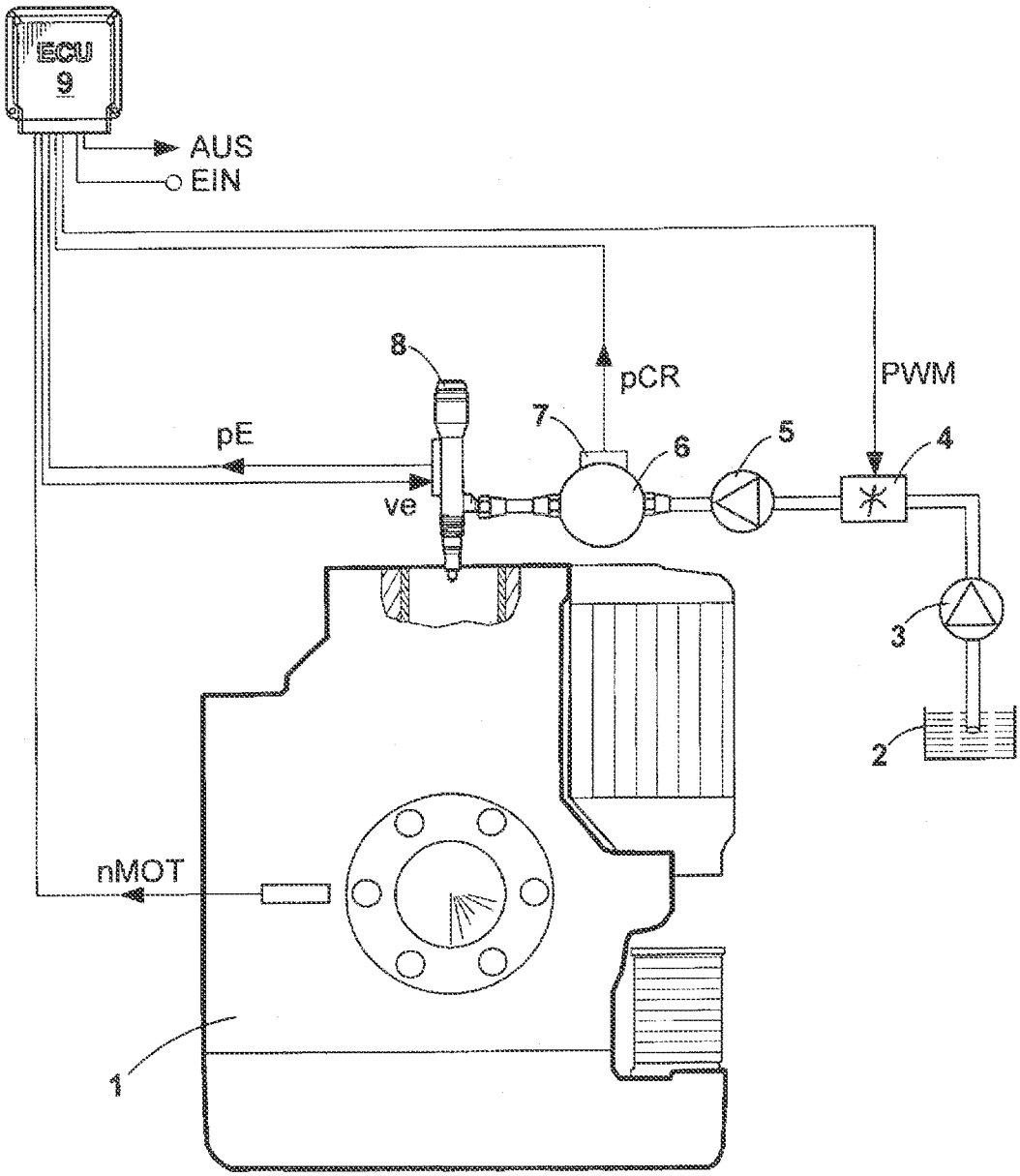
FIG. 1 is a system diagram.

FIG. 1 shows a block diagram of an electronically controlled internal combustion engine 1 with a common rail system. The common rail system comprises the following mechanical components: a low-pressure pump 3 for delivering fuel from a fuel tank 2, a suction throttle 4 for controlling the volume flow, a high-pressure pump 5, a rail 6, and injectors 8 for injecting fuel into the combustion chambers of the internal combustion engine 1.

The internal combustion engine 1 is controlled by an electronic engine control unit 9 (ECU). Input variables of the electronic engine control unit 9 shown in FIG. 1 are the rail pressure pCR, which is detected by a pressure sensor 7, the engine speed nMOT, and a variable EIN. The variable EIN is representative of other input signals, for example, input signals for the oil temperature or fuel temperature. The output variables of the electronic engine control unit 9 shown in FIG. 1 are a PWM signal PWM for activating the suction throttle 4, a power-determining signal ve for activating the injectors 8, and a variable AUS. The power-determining signal ye characterizes an injection start and an injection duration. The variable AUS represents additional control signals for controlling the internal combustion engine 1, for example, a control signal for activating an AGR valve. Naturally, the common rail system illustrated here can also be realized as a common rail system with individual accumulators. In this case, the individual accumulator is integrated in the injector 8, and then the individual accumulator pressure pE is an additional input signal of the electronic engine control unit 9.

Figure 2:
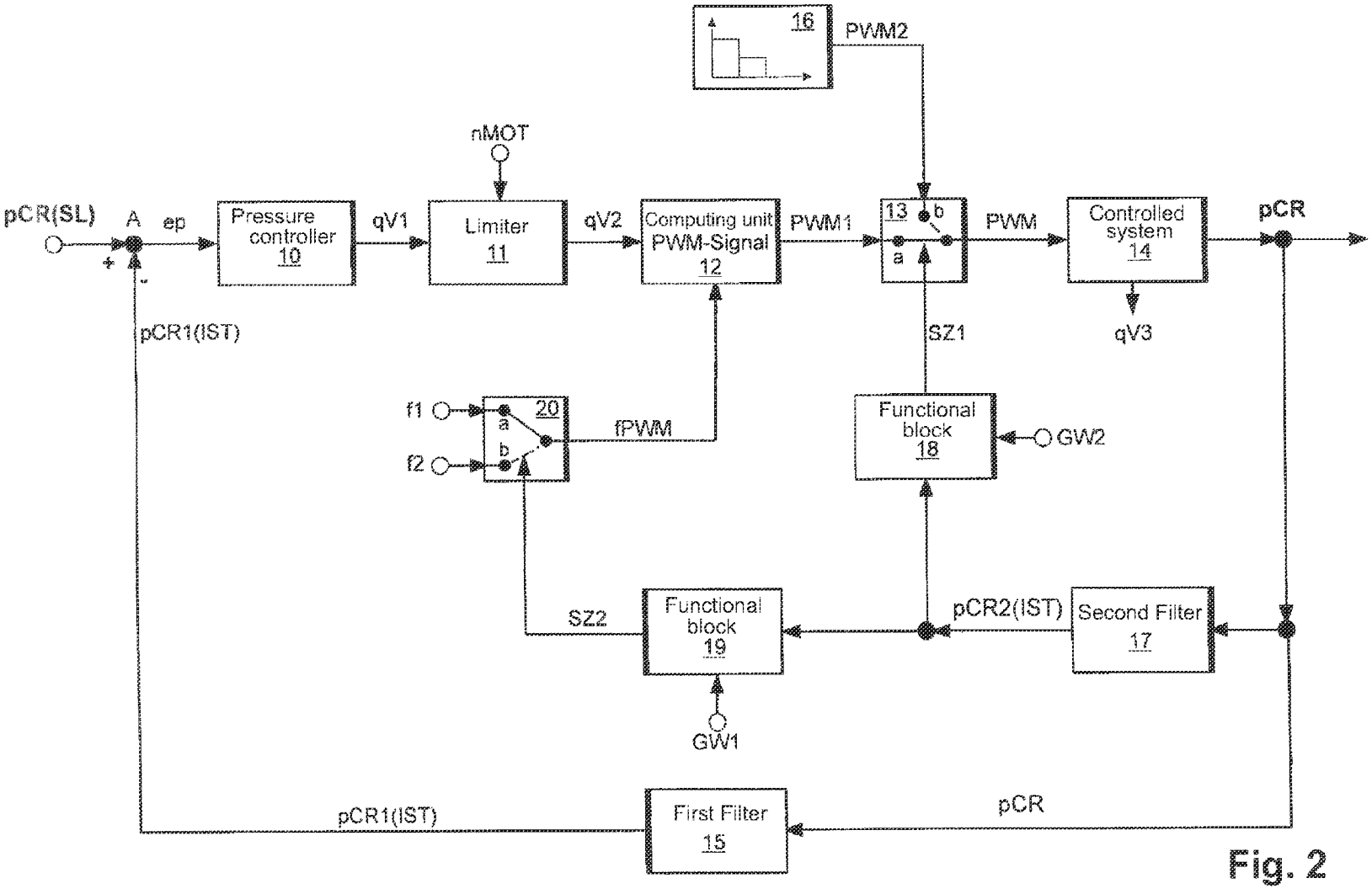
FIG. 2 is a block diagram of a closed-loop high-pressure control system.

FIG. 2 is a block diagram of the closed-loop high-pressure control system for automatically controlling the rail pressure. The input variable is a set rail pressure pCR(SL). The output variable corresponds to the raw value of the rail pressure pCR. A first actual rail pressure pCR1(IST) is determined from the raw value of the rail pressure pCR by means of a first filter 15. This value is compared with the set rail pressure pCR(SL) at a summation point A, and a control deviation ep is obtained from this comparison. A correcting variable is computed from the control deviation ep by means of a pressure controller 10. The correcting variable represents a volume flow qV1, whose physical unit is liters/minute. In an optional provision, the computed set consumption is added to the volume flow qV1. The volume flow qV1 is the input variable for a limiter 11, which can be made speed-dependent by using nMOT as an input variable. The output variable qV2 of the limiter 11 is then converted to a PWM signal PWM1 in a computing unit 12. In this regard, the PWM signal PWM1 represents the duty cycle, and the frequency fPWM corresponds to the base frequency, for example 50 Hz (period duration 20 ms). Fluctuations in the operating voltage and the ucl admission pressure are also taken into consideration in the conversion. The PWM signal PWM1 is the first input variable of a switch 13. A second input variable of the switch 13 is a PWM signal PWM2. Depending on the position of the first switch 13, the output signal PWM of the switch 13 corresponds either to the signal PWM1 or to the signal PWM2. The solenoid coil of the suction throttle is then acted upon by the PWM signal PWM. This changes the displacement of the magnetic core, and the output of the high-pressure pump is freely controlled in this way. The high-pressure pump, the suction throttle, and the rail represent a controlled system 14. A consumption volume flow qV3 is removed from the rail 6 through the injectors. The closed-loop control system is thus closed.

As DE 10 2005 029 138 B3 discloses, this closed-loop control system is supplemented by the temporary PWM assignment unit. The components of the temporary PWM assignment unit are a second filter 17 for computing a second actual rail pressure pCR2(IST), a functional block 18 for determining a signal SZ1 for activating the first switch 13, and a PWM assignment unit 16. During operation with closed-loop control, the first switch 13 is in position a, i.e., the correcting variable qV1 computed by the pressure controller 10 is limited and converted to a PWM signal PWM1, which acts on the controlled system 14. If the second actual rail pressure pCR2(IST) exceeds a limit, here: the second limit GW2, the functional block 18 changes the signal level of the signal SZ1, which causes the first switch 13 to be switched to position b. In position b, a PWM value PWM2 that is increased relative to normal operation is temporarily output by the PWM assignment unit 16. In other words, the operation is changed from closed-loop control to open-loop control. The temporary PWM assignment can be realized, as illustrated, in step form. After the expiration of a predeterminable period of time, the switch 13 then changes back to position a, so that closed-loop control is reestablished.

In practical operation, the PWM signal is provided with a low PWM frequency fPWM, for example, 50 Hz, by the corresponding drive software. Therefore, the PWM value can be updated in 20-ms time intervals. The low PWM frequency achieves the result that, first, the slide of the suction throttle moves, i.e., only the sliding friction needs to be overcome, and, second, the dissipation of the switching transistors in the electronic engine control unit remains within specifications. The pressure controller 10 is computed by the engine software with constant scanning time. If the pressure controller 10 detects a quantitatively increasing control deviation ep, it may be that a PWM period started shortly before. Therefore, the new, increased PWM duty cycle cannot be set until the beginning of the next PWM period, i.e., at the earliest after the expiration of the 20-ms time interval. This in turn means that the rail pressure pCR continues to rise during the current PWM period and also at the beginning of the next PWM period. Due to the asynchronicity of PWM signal and pressure controller scanning, a corresponding lag time thus develops.

This is where the invention comes in, namely, the block diagram of FIG. 2 additionally contains a functional block 19 and a second switch 20. During operation with closed-loop control, the second switch 20 is in position a, in which the first frequency f1 (50 Hz) determines the frequency fPWM. If the second actual rail pressure pCR2(IST) exceeds a first limit GW1 (this is the case when a load reduction occurs), the functional block 19 sets the triggering signal SZ2 for activating the second switch 20 to a second value, which causes the switch 20 to change to position b. The frequency fPWM then equals the second frequency 12 of, for example, 500 Hz. The PWM signal PWM1 is now updated every 2 ms.

If the second actual rail pressure pCR2(IST) exceeds the second limit GW2, the temporary assignment is activated. If the second actual rail pressure pCR2(IST) falls below the difference of a first limit and a hysteresis value, the switch 20 changes back to position a, so that the PWM frequency fPWM is again identical with the first frequency f1.

FIG. 3 shows a load reduction in the form of a time-dependency diagram. FIG. 3 comprises the four graphs 3A to 3D, which show the following, in each case as a function of time: FIG. 3A the behavior of the second actual rail pressure pCR2(IST), FIG. 3B the value of the PWM signal PWM, FIG. 3C the PWM signal in a pulse/pulse interval diagram according to the prior art, and FIG. 3D the PWM signal in a pulse/pulse interval diagram according to the invention. The pressure curve drawn as a solid line in FIG. 3A corresponds to the PWM signal of FIG. 3C, and the pressure curve drawn as a broken line in FIG. 3A corresponds to the PWM signal of FIG. 3D. The illustrated example is based on a first PWM frequency of 50 Hz, which corresponds to a time interval of 20 ms, and a second PWM frequency of 500 Hz, which corresponds to a time interval of 2 ms. The set rail pressure was kept constant.

The course of the method according to the prior art is as follows:

Before time t1, the internal combustion engine is operated in a steady state at a rail pressure of 1800 bars. In the steady state, the rail pressure is subject to closed-loop control. At time t1 the load is reduced, which leads to an increase in the rail pressure. An increase occurs in both the first actual rail pressure pCR1(IST) computed by the first filter (FIG. 2: 15) and the second actual rail pressure pCR2(IST) computed by the second filter (FIG. 2: 17). The increasing first actual rail pressure pCR1(IST) causes a quantitatively increasing control deviation, which the pressure controller converts to an increasing PWM signal (FIG. 3B), thereby causing the suction throttle to be moved in the closing direction. If the second actual rail pressure pCR2(IST) then exceeds the second limit GW2 at time t3 (here: 1900 bars, point B in FIG. 3A), the temporary PWM assignment is activated, so that a change is made from closed-loop control to open-loop control. Therefore, starting at time t3, the PWM signal is increased to 100% for 20 ms (FIG. 3B). At time t3, a new PWM period has just begun, so that the PWM increase is not immediately effective. See the enlarged segment in FIG. 3C. The PWM increase does not become effective until 20 ins later, i.e., one period interval later, at time t5. Pulse D in FIG. 3C corresponds to the PWM value of 100% in FIG. 3B. Due to this lag time, the second actual rail pressure pCR2(IST) continues to rise and reaches its maximum value at 2030 bars.

Figure 3A:
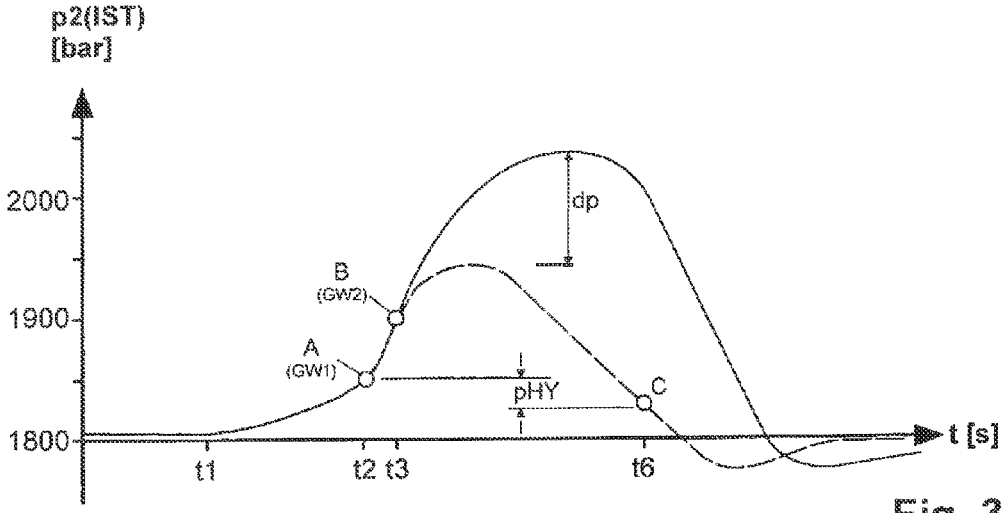
FIG. 3 shows a load reduction in the form of a time-dependency diagram.
Figure 3B:
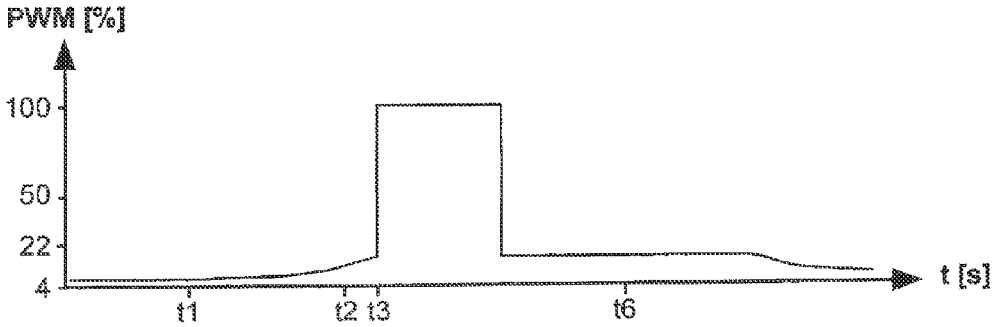
Figure 3C:
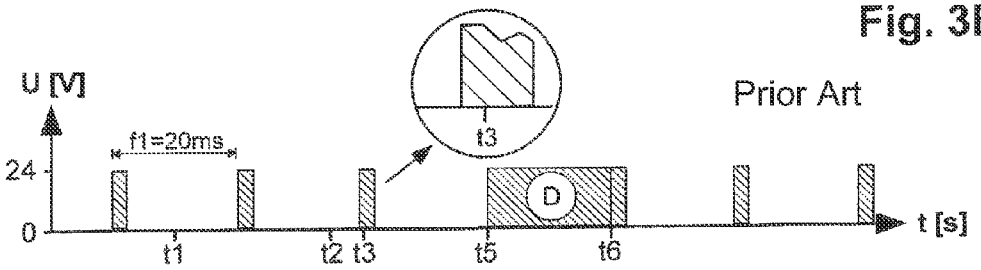
Figure 3D:
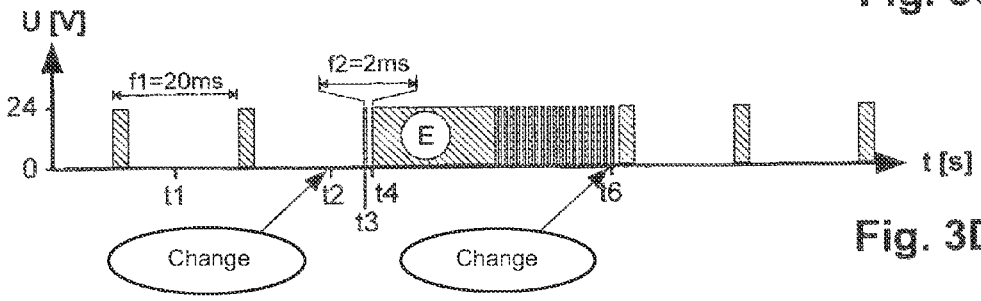

The course of the method according to the invention is as follows:

At time t2 the second actual rail pressure pCR2(IST) exceeds the first limit GW1 (here: 1850 bars, point A in FIG. 3A). When the first limit GW1 is exceeded, a change is made to the second PWM frequency of 500 Hz (FIG. 3D). At time t3 the second actual rail pressure pCR2(IST) then exceeds the second limit GW2 (here: 1900 bars, point B in FIG. 3A). When the second limit GW2 is exceeded, the temporary PWM assignment is activated, i.e., a change is made from closed-loop control to open-loop control. The pulse E in FIG. 3D (starting at time t4) corresponds to the PWM value of 100% in FIG. 3B. This time, the lag time until the PWM increase takes effect is again a whole period duration, but now this is only 2 ms. All together, the PWM increase thus takes effect 18 ms earlier. As a result, the second actual rail pressure pCR2(IST) rises only to 1940 bars this time. Therefore, the switching of the PWM frequency reduces the high-pressure overshoot by 90 bars. In FIG. 3A, this is represented by the reference symbol dp.

The increase in the PWM frequency is deactivated when the second actual rail pressure pCR2(IST) falls below the first limit GW1 by a predeterminable hysteresis value pHY, for example, 30 bars, at point C. As a result, the frequency is changed back from the second frequency of 500 Hz to the first frequency of 50 Hz (see FIG. 3D at time t6). Since, in accordance with the invention, a change to a high PWM frequency is made only during the high-pressure overshoot (time t2/t6), the heat generation of the high power stage remains within allowable hardware specifications despite the large number of transistor switching operations.

Figure 4:
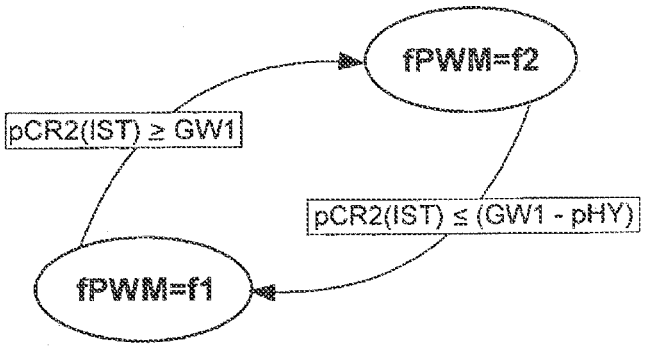
FIG. 4 is a state diagram.

The switching logic of the invention is shown in FIG. 4. In steady-state operation, the PWM frequency fPWM is set to the first frequency f1, for example, 50 Hz. If the second actual rail pressure pCR2(IST) becomes greater than or equal to the first limit GW1, then the PWM frequency tPWM is set to the second frequency f2, for example, 500 Hz. A switch back to the first frequency f1 occurs when the second actual rail pressure pCR2(IST) falls below the limit GW1 by an amount equal to the hysteresis value pHY.

Figure 5:
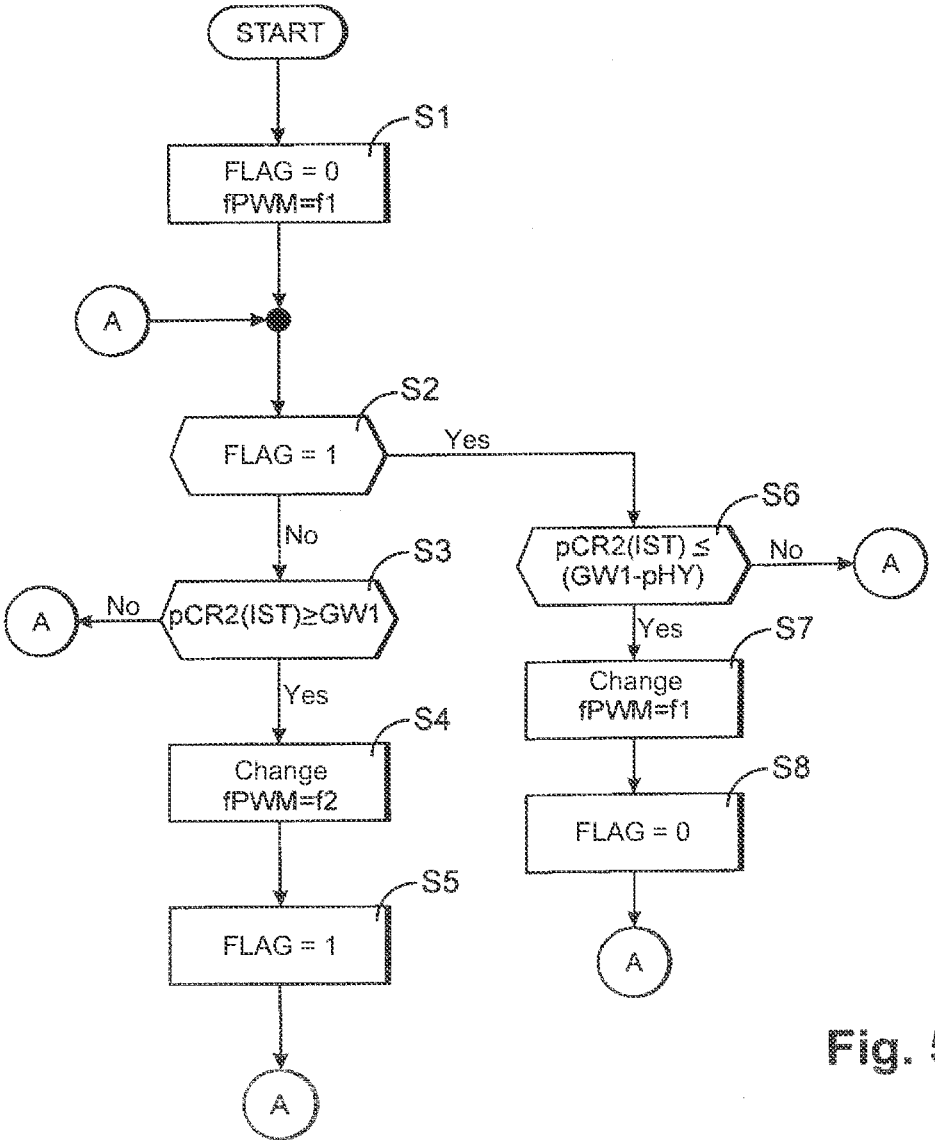
FIG. 5 is a program flowchart.

FIG. 5 is a program flowchart of the method of the invention. At S1 a flag is initialized with a value of 0, and the frequency fPWM of the PWM signal is set to the value f1, for example, 50 Hz. An interrogation at S2 checks the value of the flag. If the value is 1, program control passes to the routine with the steps S6 to S8. However, if the value of the flag is 0, program control passes to the routine with the steps S3 to S5. During the first pass through the program (flag=0), a check is then made at S3 to determine whether the second actual rail pressure pCR2(IST) has reached or exceeded the first limit GW1. If this is not the case (interrogation result S3: no), the internal combustion engine is operating in the steady state, and the program flow continues at A. However, if a load reduction is detected at S3 (interrogation result S3: yes), then at S4 the frequency is changed to the second frequency t2, for example, 500 Hz. The PWM value can now be changed with a 2-ms time interval. At S5 the flag is then changed to a value of 1, and the program flow continues at A. If the interrogation at S2 shows that the flag has a value of 1 (interrogation result S2: yes), then at S6 a check is made to determine whether the second actual rail pressure pCR2(IST) is less than or equal to the switch-off threshold. The switch-off threshold is set to the difference between the first limit GW1 and the hysteresis value pHY. If the second actual rail pressure pCR2(IST) has not yet fallen below the switch-off threshold, the program flow continues at A. If the second actual rail pressure pCR2 (IST) has reached or fallen below the switch-off threshold (interrogation result S6: yes), then at S7 the frequency fPWM of the PWM signal is switched from the second frequency f2 back to the first frequency f1. At S8 the flag is then set back to its initialization value of 0, and the program flow continues at A.

LIST OF REFERENCE NUMBERS 1 internal combustion engine
2 tank
3 low-pressure pump
4 suction throttle
5 high-pressure pump
6 rail
7 pressure sensor (rail)
8 injector
9 electronic engine control unit (ECU)
10 pressure controller
11 limiter
12 computing unit PWM signal
13 first switch
14 controlled system
15 first filter
16 PWM assignment unit
17 second filter
18 functional block
19 functional block
20 second switch

The invention claimed is:

1. A method for open-loop and closed-loop control of an internal combustion engine with a common rail system, comprising the steps of: controlling rail pressure (pCR) during normal operation by closed-loop control; determining a first actual rail pressure (pCR1(IST)) from the rail pressure (pCR)

by a first filter; computing a control deviation (ep) from a set rail pressure (pCR(SL)) and the first actual rail pressure (pCR1(IST)); computing a correcting variable (qV1) from the control deviation (ep) by a pressure controller; determining a PWM signal (PWM1) with a first PWM frequency (f1) for controlling a controlled system as a function of the correcting variable (qV1); determining a second actual rail pressure (pCR2(IST)) by a second filter; detecting a load reduction if the second actual rail pressure (pCR2(IST)) exceeds a first limit (GW1), and when the first limit (GW1) is exceeded, switching the PWM signal (PWM1) from the first PWM frequency (f1) to a second PWM frequency (f2); and, when a second limit (GW2) is exceeded, changing control of the rail pressure (pCR) to open-loop control by temporarily setting the PWM signal (PWM1) to a PWM value (PWM2) that is increased compared to normal operation.

2. The method in accordance with claim 1, including deactivating the open-loop control operation with increased PWM value (PWM2) after expiration of a period of time, and activating operation with closed-loop control.

3. The method in accordance with claim 2, including changing the PWM signal (PWM1) from the second PWM frequency (f2) to the first PWM frequency (f1) if the second actual rail pressure (pCR2(IST)) falls back below the first limit (GW1) by a hysteresis value (pHY).

* * * * *